US009295294B2

(12) United States Patent
Fildan et al.

(10) Patent No.: US 9,295,294 B2
(45) Date of Patent: Mar. 29, 2016

(54) LINGERIE FASTENER

(71) Applicants: Gerhard Fildan, Vienna (AT); Karl Wanzenboeck, Teesdorf (AT)

(72) Inventors: Gerhard Fildan, Vienna (AT); Karl Wanzenboeck, Teesdorf (AT)

(73) Assignee: FILDAN ACCESSORIES (HK) LTD., Kwua Tong Kowloon (HK)

( * ) Notice: Subject to any disclaimer, the term of this patent is extended or adjusted under 35 U.S.C. 154(b) by 202 days.

(21) Appl. No.: 14/135,196

(22) Filed: Dec. 19, 2013

(65) Prior Publication Data

US 2015/0173441 A1 Jun. 25, 2015

(51) Int. Cl.
*A41F 1/00* (2006.01)
*A41C 3/02* (2006.01)

(52) U.S. Cl.
CPC . *A41F 1/006* (2013.01); *A41C 3/02* (2013.01); *Y10T 24/45037* (2015.01)

(58) Field of Classification Search
CPC ..... Y10T 24/45037; Y10T 24/45178; Y10T 24/45215; Y10T 24/45241; Y10T 24/43; Y10T 24/45005; Y10T 24/45052; Y10T 24/45099; Y10T 24/45225; A41F 1/006; A41C 3/02
See application file for complete search history.

(56) References Cited

U.S. PATENT DOCUMENTS 1,205,247 A * 11/1916 Munroe ..... A44B 99/005 24/594.1
5,784,765 A * 7/1998 Fildan ..... A41C 3/0028 24/615
5,957,748 A * 9/1999 Ichiha ..... A41C 3/0028 24/578.14
2006/0107503 A1* 5/2006 Liu ..... A44B 11/2592 24/579.09
2012/0102686 A1* 5/2012 Wanzenboeck ..... A41F 1/006 24/591.1
2014/0357156 A1 12/2014 Yip

* cited by examiner

*Primary Examiner* — Robert J Sandy
*Assistant Examiner* — Matthew Sullivan
(74) *Attorney, Agent, or Firm* — Andrew Wilford

(57) ABSTRACT

A fastener for releasably joining elements of a garment has a male part formed with a pair of oppositely projecting tongues each having a latch tab. A first female part adapted to be mounted on one of the elements is formed with a socket complementary to one of the tongues and is provided with a formation that latches with the tab of the respective tongue when same is inserted in the socket. A second female part adapted to be mounted on the other of the elements is similarly formed with a socket complementary to the other of the tongues, and is provided with a manually releasable latch formation that can move between a holding position latched with the tab of the respective tongue when same is inserted into the respective socket and a freeing position allowing the respective tongue to withdraw from the respective socket.

7 Claims, 6 Drawing Sheets

LINGERIE FASTENER

FIELD OF THE INVENTION

The present invention relates to a lingerie fastener. More particularly this invention concerns a front or back brassiere fastener.

BACKGROUND OF THE INVENTION

A typical brassiere has a pair of cups connected together at inner edges in the center of the chest of the wearer and connected by back straps extending from outer edges of the cups around to the back of the wearer where they form wings that are connected together. Normally shoulder straps extend up from the rear ends of the back straps, over the shoulders, and then down to top edges of the cups.

A fastener is invariably provided so that the brassiere can be opened or closed for putting on and taking off. This fastener can be provided in the front between the cups or in the rear between the wing ends of the back straps.

Such a fastener is typically a simple hook/eye assembly, or, in a large-size brassiere, two or more rows of such fasteners. Opening and closing such a fastener, especially in the back, is a difficult operation, especially as it is typically set up so the more difficult manipulation is on the right side, so that a left-hander is at a disadvantage. In addition the fastener is frequently unattractive or, at the very least, so obviously functional that it detracts from the appearance of otherwise attractive garment, and also forms an unsightly bump visible through the wearer's clothing.

OBJECTS OF THE INVENTION

It is therefore an object of the present invention to provide an improved lingerie fastener.

Another object is the provision of such an improved lingerie fastener that overcomes the above-given disadvantages, in particular that can be used in the front or back of a brassiere, and that is easy to use and attractive.

A further object is to provide a lingerie fastener that offers a degree of adjustment.

A final object is to provide such a fastener that can be set up for comfortable right- or left-hand use.

SUMMARY OF THE INVENTION

A fastener for releasably joining elements of a garment has according to the invention a male part formed with a pair of oppositely projecting tongues each having a latch tab. A first female part adapted to be mounted on one of the elements is formed with a socket complementary to one of the tongues and is provided with a formation that latches with the tab of the respective tongue when same is inserted in the socket. A second female part adapted to be mounted on the other of the elements is similarly formed with a socket complementary to the other of the tongues, and is provided with a manually releasable latch formation that can move between a holding position latched with the tab of the respective tongue when same is inserted into the respective socket and a freeing position allowing the respective tongue to withdraw from the respective socket.

Each latch tab according to the invention is sawtooth shaped with a slide-on ramp flank that engages the respective formation when inserted into the respective socket and a perpendicular catch face engaging behind the respective formation when inserted into the respective socket.

Thus the fastener of this invention is comprised to start with of at least three parts. In the simplest embodiment the first female part is formed such that, after one of the tongues is inserted in its socket, the one tongue is locked permanently therein. Thus this embodiment is typically assembled by the manufacturer and, once the tongue is installed, it is never removed.

In an embodiment that allows the fastener to be adjusted for right- or left-handed users, the first female part is identical to the second part. Thus it also is provided with a manually releasable latch formation that can move between a holding position latched with the tab of the respective tongue when same is inserted into the respective socket and a freeing position allowing the respective tongue to withdraw from the respective socket. With this system the tongue part can be installed in either female part, depending on which hand the user wants to use to release it.

In a further embodiment that provides for adjustable fastener length, relative to a longitudinal axis of the male part, at least one of the tongues is formed with a pair of longitudinally spaced latch tabs. The second part is formed with a passage such that, depending on how deeply the one tongue is inserted into the socket of the second part, one or the other of the two latch tabs of the one tongue latches with the latch formation of the second part. It is also possible to form both parts with such a passage and with a releasable latch formation for the ability to set the fastener at any of three different lengths. Such a fastener, when used as a front fastener can serve for adjusting cleavage or uplift.

The female parts according to the invention each have outer surfaces provided with fabric overlays that cover all but a mouth of the respective socket. Thus the entire fastener can be in effect imbedded in the wing straps, for instance, and virtually disappear when closed.

BRIEF DESCRIPTION OF THE DRAWING

The above and other objects, features, and advantages will become more readily apparent from the following description, reference being made to the accompanying drawing in which.

SPECIFIC DESCRIPTION OF THE INVENTION

Figure 1:
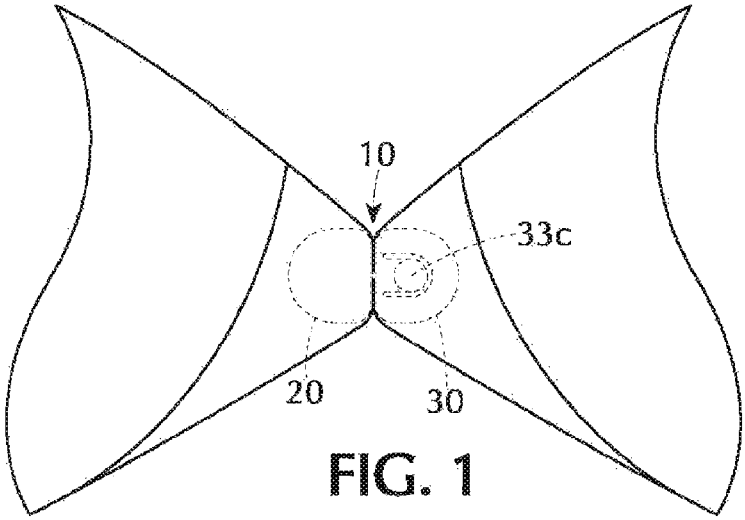
FIG. 1 is a detail view of the fastener of this invention used as a front fastener.
Figure 2:
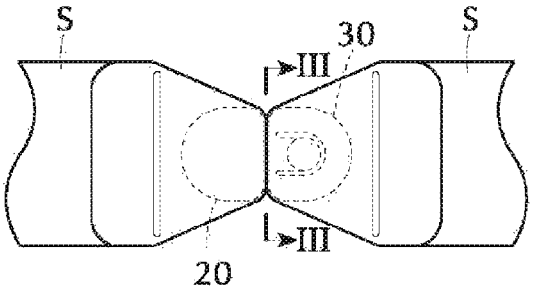
FIG. 2 is a view of the fastener of this invention used as a back fastener.
Figure 3:
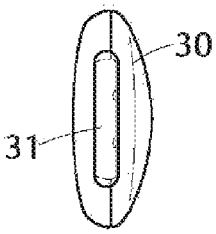
FIG. 3 is a view along plane III of FIG. 2 of only the female part of the fastener.
Figure 4:
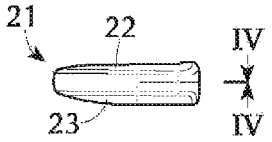
FIG. 4 is a side view of a clamshell of the male part of the fastener of the invention.
Figure 7:
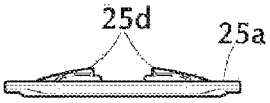
FIG. 7 is an edge view of a double-tongue insert of this invention.

The fastener 10 according to this invention can be secured between the two front cups C of a standard brassiere as shown in FIG. 1, or between the ends of two back straps or wings S as shown in FIG. 2. The fastener 10 comprises a male part 20 and a female part 30 that fit together and are both virtually completely hidden when the fastener 10 is closed in use as illustrated. The fabric of the brassiere covers the fastener 10 when closed. When opened as shown in FIG. 3 a socket hole 31 of the female part 30 is exposed. An operating button 33*c* of the female part 30 is covered by the textile cover of the brassiere and not visible.

The male part 20 as shown in FIG. 4-9 is made of two polyamide parts, namely a one-way female clamshell 21 formed by a top wall 22 and a bottom wall 23 themselves forming a socket hole 24, and an insert 25 having a pair of identical tongues 25*a*. The two clamshell walls 22 and 23 have respective cavities 22*a* and 23*a* that fit together to form the hole 24 that is complementary to one of the tongues 25*a*. An outer edge 25*e* of each the tongues 25 is rounded but asymmetrical to a longitudinal axis bisecting the tongues 25*a*, and the cavity 22*a* is similarly complementarily formed so that the tongues 25*a* can only be fitted in one position into the hole 24 formed by the cavities 22*a* and 23*a*. In addition each tongue 25*a* has U-shaped cutout 25*b* defining a latch tab 25*c* having a sawtooth 25*d*. The insert 25 is made of polyoxymethylene.

Figure 5:
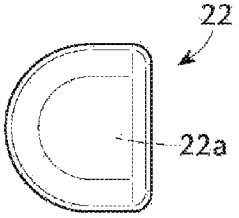
FIGS. 5 and 6 are sections taken as shown by arrows V and VI in FIG. 4 respectively showing the bottom and top side of the male-part clamshell.
Figure 8:
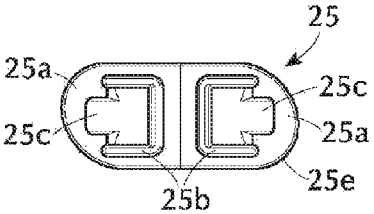
FIGS. 8 and 9 are bottom and top views of the insert of FIG. 7.

In use the two clamshell halves 22 and 23 are joined permanently together as shown in FIG. 5 so that their cavities 22*a* and 23*a* open toward each other and together form the hole 24. Then one of the tongues 25*a* is pushed into the hole 24 and, if the shape of the tongue 25*a* matches the shape of the hole 24 the tooth 22*d* snaps behind a front edge 23*b* of the cavity 23*a*, permanently locking the insert 25 to the clamshell 21. If the tongue 25*a* is inserted in the wrong orientation, it cannot be pushed in far enough for the tooth 22*d* to lock behind the edge 23*b*. Thus once one of the tongues 25*a* if pushed into the closed female clamshell 22, it cannot be removed without use of a special tool or damage to the parts 22 and/or 25.

Figure 10:
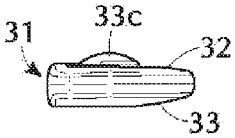
FIG. 10 is an edge view of a female fastener part.
Figure 11:
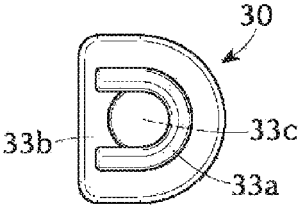
FIGS. 11 and 12 are top and bottom views of the female so part.
Figure 6:
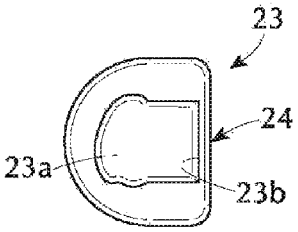
Figure 9:
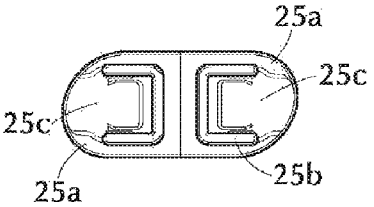
Figure 12:
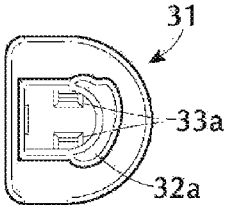

The releasable female part 30 as shown in FIGS. 10-12 is formed by two parts 32 and 33 that are fixed together and form the socket hole 31 adapted to releasably receive the tongue 25*a* projecting from the female clamshell 21, 22. The lower clamshell wall 32 is formed with a cavity 32*a* substantially identical to the cavity 23*a* so that the tongues 25*a* can only fit in one orientation into it. The upper clamshell wall 33 is formed with a U-shaped cutout 33*a* defining a deflectable tab 33*b* having an outwardly turned part-spherical actuating button 33*c* and with an inwardly directed pair of actuating bumps or nibs 33*d*. The wall 33 is also formed with an edge 33*b* (see FIG. 13) like the edge 23*b* that the tooth 25*d* can lock behind.

Engaging a tongue 25*a* into the hole 31 will lock it in place by the engagement of the sawtooth 25*d* with the edge 33*b*. Incorrect orientation will not allow the tongue 25*a* to lock in the hole 31. When thus inserted, the tooth 25*d* therefore locks the female part 20 to the male part 30.

Once the tongue 25*a* is locked in the female part 30, an inward (down in FIG. 10) pressure on the button 33*c* will press the nibs 33*d* down against the same face of the tab 25*c* that the tooth 25*d* projects from. This causes the tab 25*c* to deflect elastically and disengage the tooth 25*d* from the edge 33*b*, allowing the parts 20 and 30 to be separated.

Thus the fastener shown in FIGS. 5-13 is typically assembled on installation and, once the part 25 is pushed into the part 22, it stays there.

Figure 13:
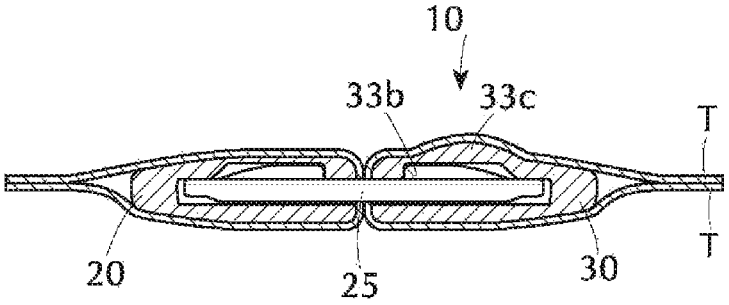
FIG. 13 is a longitudinal section through the assembled fastener of the parts shown in FIGS. 4-12.
Figure 14:
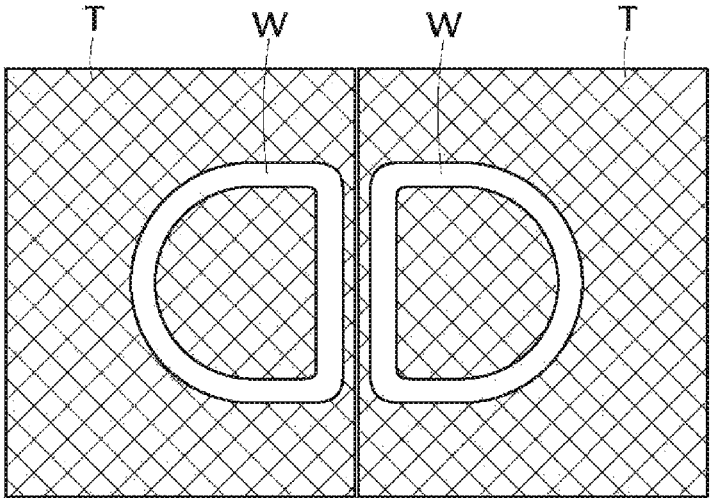
FIG. 14 is a plan view illustrating the manner the fastener parts are secured to their textile overlays.

FIGS. 13 and 14 illustrate how layers T of textile are bonded at ultrasonic welds W to the outer faces of the parts 20 and 30. The welds run around the edges of the slightly domed and smooth outer faces of the parts 20 and 30 and the textile layers T are formed with holes matching the holes 31 and 24, and are bonded to the plastic of the parts 20 and 30 around these holes 31 and 24. The result is therefore a fastener that is wholly imbedded in the straps or parts of the garment it is being used in, with at most a clearance of about 0.8 mm between the parts 20 and 30 at the respective holes 24 and 31. Thus the fastener can be incorporated in a fashionable garment without in any way detracting from its appearance.

Figure 15:
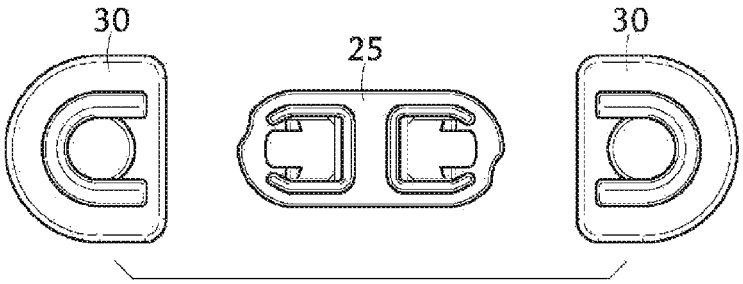
FIG. 15 is an exploded view of a second fastener assembly according to the invention.
Figure 16:
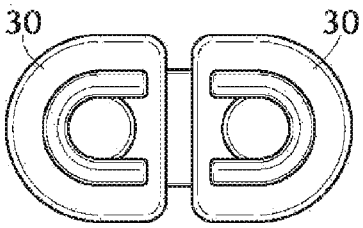
FIG. 16 is a top view of the assembled second fastener of FIG. 15.

FIGS. 15 and 16 show how the two-tongue male part 25 can be mounted between a pair of the releasable female parts 30. The advantage of this system is that it can be assembled by the end user, with a left-handed user inserting the dual-tongue mail part into the clamshell on the right side so that she can manipulate the trickier male part with her more dextrous hand.

Figure 17:
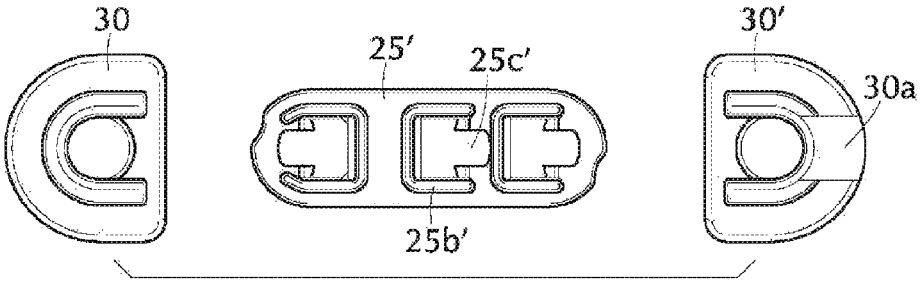
FIG. 17 is an exploded top view of a third fastener assembly of this invention with an adjustable-length tongue insert and a two-way female part.
Figure 18A:
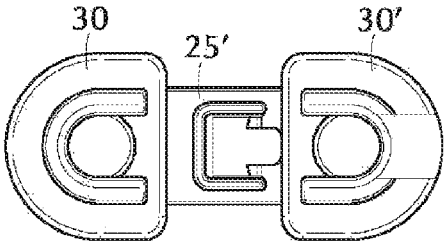
FIGS. 18A and 18B are top views of the third assembly of FIG. 17 in two use positions of different lengths.
Figure 18B:
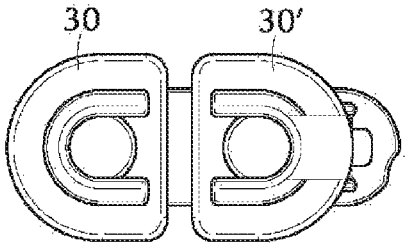
Figure 19:
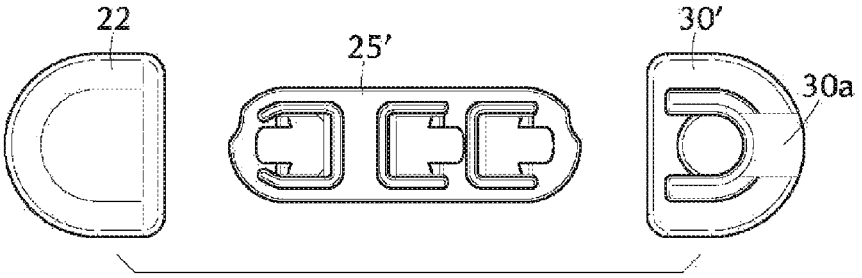
FIG. 19 is an exploded top view of a fourth fastener assembly that is a variation on the FIG. 17 third assembly with the adjustable-length tongue insert, a two-way female part, and a clamshell.
Figure 20A:
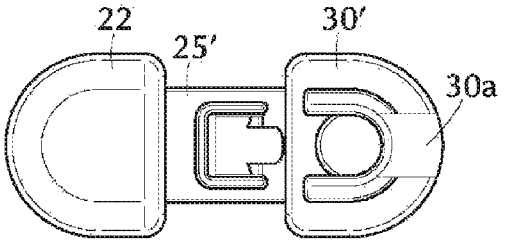
FIGS. 20A and 20B are top views like FIGS. 18A and 18B of the fourth fastener of FIG. 19 in two use positions of different lengths.
Figure 20B:
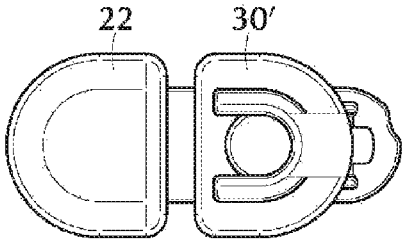
Figure 21A:
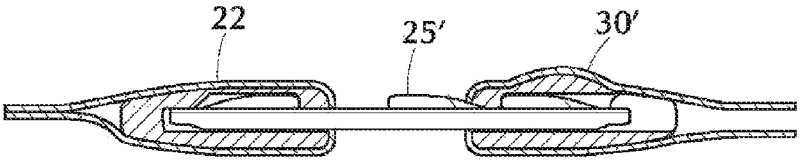
FIGS. 21A and 21B are longitudinal sections through the fourth fastener as shown in respective FIGS. 20A and 20B.
Figure 21B:
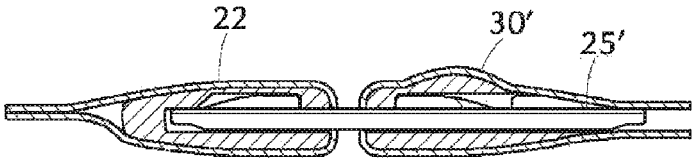
Figure 22:
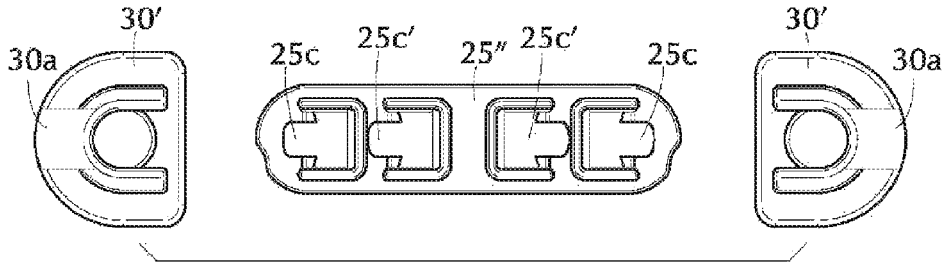
FIG. 22 is an exploded top view of a fifth fastener assembly that is another variation on the FIG. 17 third assembly.
Figure 23A:
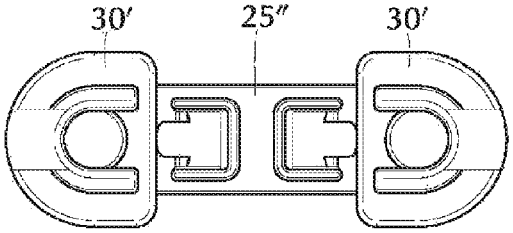
FIGS. 23A, 23B, 23C, and 23D are top views of the fifth fastener in use positions of different lengths.
Figure 23B:
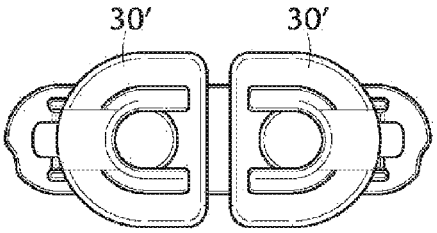
Figure 23C:
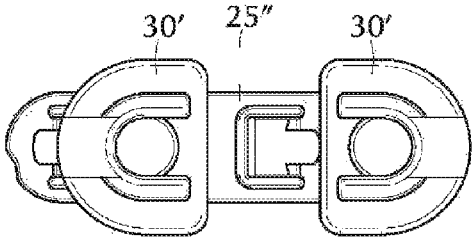
Figure 23D:
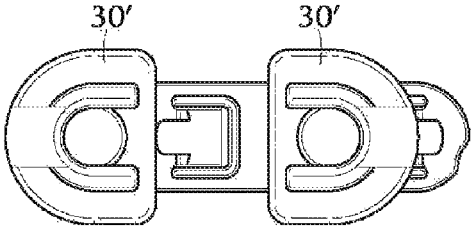

FIGS. 17, 18A, and 18B illustrate a system where the male part 25' has on one side a second the cutouts 25*b'* defining a second latch tab 25*c'*. In addition the releasable female part 30' here has a throughgoing passage 30*a* so that, depending on which of the tabs 25*c* or 25*c'* is latched in it, the fastener has one of two different lengths as shown in FIGS. 18A and 18B. Thus this fastener is of adjustable length, and can be opened at each end.

FIGS. 19, 20A, 20*b*, 21A, and 21B show the three-tab or adjustable length male part 25' of FIG. 17 along with a closed clamshell 22 and a two-way clamshell 30'. This system therefore is typically assembled by the manufacturer and can only be opened from one side.

Finally, FIGS. 22 and 23A-23D show a pair of releasable female parts 30 together with a four-tab male part 25", having two inner tabs 25*c'* and two outer tabs 25*c*. Thus as shown in FIGS. 23A, 23B, 23C, and 23D this fastener can vary from a maximum length (FIG. 23A) here the two outer tabs 25*c* are locked in the female parts 30', a minimum length (FIG. 23B) with both of the inner tabs 25*c'* locked in the female parts 30', and an intermediate length (FIGS. 23C and 23D) with one of the inner tabs 25*c'* held in one of the reclosable female parts 30' and the one of the outer tabs 25*c* held in the other reclosable female part 30'.

We claim:

1. A fastener for releasably joining elements of a garment, the fastener comprising:

a male part formed with a pair of oppositely projecting tongues each having an elastically laterally deflectable latch tab formed with a respective laterally projecting latch tooth;

a first female part adapted to be mounted on one of the elements and formed with a socket complementary to one of the tongues, and a formation that latches with the tooth of the tab of the one tongue when same is inserted in the socket so as to prevent retraction of the tab of the one tongue from the first part; and a second female part adapted to be mounted on the other of the elements and formed with a socket complementary to the other of the tongues, a formation that latches in a holding position with the tooth of the tab of the other tongue when same is inserted into the respective socket to prevent retraction of the tab of the other tongue from the second part, and an actuating button engageable with the latch tab of the other tongue and depressable into the second part to move the formation of the other element out of the holding position and engagement with the respective tooth and into a freeing position allowing the other tongue to withdraw from the socket of the second part.

2. The fastener defined in claim 1, wherein each latch tab is sawtooth shaped with a slide-on ramp flank that engages the respective formation when inserted into the respective socket and a perpendicular catch face engaging behind the respective formation when inserted into the respective socket.

3. The fastener defined in claim 1, wherein the first female part is formed such that, after one of the tongues is inserted in its socket, the one tongue is locked permanently therein.

4. The fastener defined in claim 1, wherein the first female part is identical to the second part and provided with an actuating button that be depressed from a holding position in which the respective latch formation is latched with the tooth of tab of the respective tongue when same is inserted into the respective socket and a freeing position allowing the respective tongue to disengage from the tooth and withdraw from the respective socket.

5. The fastener defined in claim 1, wherein relative to a longitudinal axis of the male part, at least one of the tongues is formed with a pair of longitudinally spaced latch tabs, the second part being formed with a passage such that, depending on how deeply the one tongue is inserted into the socket of the second part, one or the other of the two latch tabs of the one tongue latches with the latch formation of the second part.

6. The fastener defined in claim 1, wherein relative to a longitudinal axis of the male part, each of the tongues is formed with a pair of longitudinally spaced latch tabs, the second female part is formed like the first female part with a releasable latch formation, both female parts being formed with a passage such that, depending on how deeply a one of the tongues is inserted into the respective socket, one or the other of the two latch tabs of the respective tongue latches with the latch formation of the female part.

7. The fastener defined in claim 1, wherein the female parts each have outer surfaces provided with fabric overlays that cover all but a mouth of the respective socket.

* * * * *